US007481345B2

(12) United States Patent
Rice

(10) Patent No.: US 7,481,345 B2
(45) Date of Patent: Jan. 27, 2009

(54) SYSTEM AND METHOD FOR DISPENSING FOIL OR FILM

(76) Inventor: Bob Rice, 726 Mello Oak, San Antonio, TX (US) 78258

( * ) Notice: Subject to any disclaimer, the term of this patent is extended or adjusted under 35 U.S.C. 154(b) by 269 days.

(21) Appl. No.: 11/312,855

(22) Filed: Dec. 20, 2005

(65) Prior Publication Data

US 2006/0151564 A1 Jul. 13, 2006

Related U.S. Application Data

(60) Provisional application No. 60/637,534, filed on Dec. 20, 2004, provisional application No. 60/644,847, filed on Jan. 19, 2005.

(51) Int. Cl.
*B26F 3/02* (2006.01)
*B65H 75/32* (2006.01)
*B26D 1/00* (2006.01)

(52) U.S. Cl. ..... 225/1; 225/16; 225/38; 225/42; 225/106; 83/13; 83/175

(58) Field of Classification Search ..... 225/16, 225/106, 38, 43, 1, 20, 22, 25, 34, 39, 42, 225/46, 47, 66, 89; 83/650, 175, 649, 13, 83/455, 610, 456, 454, 375, 378, 382, 387–389
See application file for complete search history.

(56) References Cited

U.S. PATENT DOCUMENTS

| | | | | |
|---|---|---|---|---|
| 441,383 | A | 11/1890 | Tivy | |
| 2,654,544 | A | 10/1953 | Pusheck | |
| 3,062,606 | A * | 11/1962 | Magrauth | 312/34.24 |
| 3,249,273 | A * | 5/1966 | Robinson | 225/16 |
| 3,317,099 | A * | 5/1967 | Solomon | 225/23 |
| 3,603,519 | A * | 9/1971 | Brown et al. | 242/594.1 |
| 4,344,551 | A | 8/1982 | Albin | |
| 4,444,359 | A * | 4/1984 | Butler | 242/598.6 |
| 5,193,726 | A | 3/1993 | Humphry | |
| 6,079,603 | A * | 6/2000 | Smegal | 225/1 |
| 6,725,753 | B2 * | 4/2004 | Bell | 83/175 |
| 6,749,097 | B1 | 6/2004 | McElhinny | |

FOREIGN PATENT DOCUMENTS

| | | |
|---|---|---|
| WO | WO 92/16445 | 10/1992 |

* cited by examiner

*Primary Examiner*—Ghassem Alie

(57) ABSTRACT

A foil or film dispensing system and method includes two brackets. The first bracket supports a roll of foil or film and is positionable in the unused space behind a door panel in a fixed cabinet. The second bracket is hingedly mounted to the first bracket and includes a cutting edge for making a sheet of foil or film. When not in use the foil or film dispensing system is hidden in the unused space behind the door panel in a cabinet.

2 Claims, 6 Drawing Sheets

SYSTEM AND METHOD FOR DISPENSING FOIL OR FILM

This application claims priority from Provisional U.S. Patent Application No. 60/637,534 filed Dec. 20, 2004 and Provisional U.S. Patent Application No. 60/644,847 filed Jan. 19, 2005.

FIELD

The present invention pertains to foil or film dispensers; more particularly, the present invention pertains to a system for mounting a foil or film dispenser in a normally unused space in a fixed cabinet or wall mounted cupboard.

BACKGROUND

Following WW II, there was a dramatic increase in the use of aluminum foil in homes. The uses of aluminum foil became wide ranging, from storing food items in a refrigerator, to heating items in an oven, to lining shelves. Use of aluminum foil became so popular that aluminum foil nearly replaced its predecessor, wax paper. Because of the low price and many uses for aluminum foil, it became difficult to find a household that did not have one or more loose rolls of aluminum foil stored in a pantry, a drawer or a cabinet to be ready for use as needed.

Aluminum foil is typically wrapped around a cardboard roll. The wrapped roll of aluminum foil with the cardboard roll contained therein is then packaged in a long box. Some long boxes of aluminum foil include a cutting edge over which the aluminum foil may be drawn before cutting off a sheet. As indicated above, the long boxes of unused aluminum foil are often stored in a drawer, a cabinet or in a pantry—sometimes in a door mounted basket specifically sized for holding the long boxes which contain a roll of aluminum foil.

In commercial establishments where large amounts of aluminum foil are consumed, a large roll of unused aluminum foil may be either left in a box or mounted to a holder positioned near a workspace. Generally, such large rolls of aluminum foil are unsightly and they consume a large amount of space that could be more effectively used to store or preposition tools such items as foodstuffs, or food preparation implements.

In the 1950's, thin plastic film became readily available for home use. Because of the great utility of thin plastic film, most households kept loose stored rolls of both aluminum foil and thin plastic film. Much like aluminum foil, rolls of thin plastic film are packaged in a long box. The long box is then stored in a drawer, a cabinet or pantry until needed. In larger applications, a large, unsightly roll of plastic film is positioned near a workspace taking up much needed space for such items as foodstuffs, kitchen tools or food preparation implements.

There is therefore a need in the art for a system and method to move a roll of aluminum foil or thin plastic film out of a work area to free up space for such items as foodstuffs, kitchen tools or food preparation implements.

SUMMARY

The system and method for dispensing foil and film of the present invention moves a roll of foil or film out of a work space into heretofore unused space in a fixed cabinet to provide more space for other items.

The foil or film dispensing system and method of the present invention includes two brackets. One bracket provides for rotatably mounting a roll of foil or a roll of film in a space which is generally not used, such as the space behind and beneath a horizontally oriented panel in a fixed cabinet or the unused space adjacent to the underside of a shelf in a wall mounted cupboard. The other bracket which supports the roll of foil or film allows for dispensing of a section of foil or film in sheets of variable lengths as needed by a user. An edge for cutting the foil or film is also provided.

In the embodiment in which the foil or film or film dispensing system and method of the present invention is mounted in the unused space behind and beneath a hinged horizontally oriented panel in a fixed cabinet, the first bracket is constructed to hold the stored foil or film and is affixed to a frame piece or brace member within the fixed cabinet into which the horizontally oriented panel fits when closed. The second bracket is positioned adjacent to the first bracket so that when the hinged horizontally oriented door is opened, the foil dispensed from the roll of foil or film may be drawn over a cutting edge. When the desired amount of foil or film has been dispensed, the user brings the dispensed amount of foil or film into contact with the cutting edge and cuts off a length of foil, or film, hereinafter referred to as a foil or film sheet. After the cut foil or film sheet has been removed, the hinged horizontally oriented panel may be thus closed thus masking the presence of the stored foil or film roll.

In the embodiment in which the foil or film dispensing system and method of the present invention is mounted adjacent to the underside of a shelf in a wall mounted cupboard, the first bracket is affixed to the bottom of the shelf. A portion of the second bracket provides a mounting for the roll of foil or the roll of film in which the roll of foil or film may rotate. The second bracket, which is hingedly affixed to the first bracket, includes a cutting edge. The second bracket has two positions with respect to the first bracket. In the up or stored position, the second bracket is positioned against the first bracket. In the down or cutting position, the second bracket drops down to form a small acute angle with respect to the first bracket. In this down position, the foil or film may be drawn from the roll of foil or the roll of film over the cutting edge and brought into contact therewith. Contact with the cutting edge will enable cutting the unrolled length of foil or film dispensed from the roll into sheets so that the user may obtain the size of foil or film sheet desired. When the sheet of foil or film of the desired length has been obtained, the second bracket may be moved back up into the stored position against the first bracket.

BRIEF DESCRIPTION OF THE DRAWING FIGURES

The system and method of the present invention for dispensing foil or film may be better understood by reference to the drawing figures wherein.

DESCRIPTION OF THE EMBODIMENTS

Figure 1:
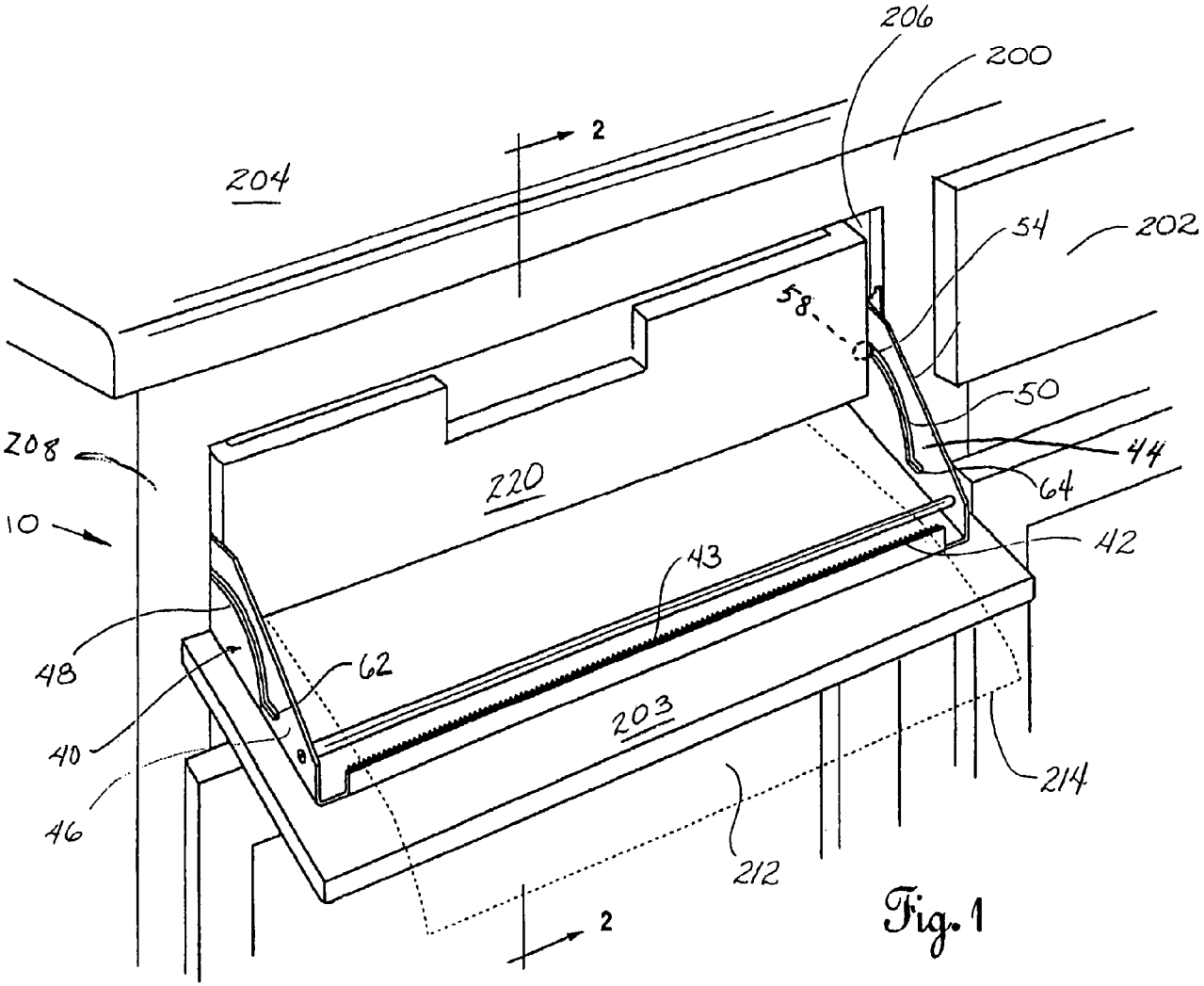
FIG. 1 is a perspective view of a first embodiment of the system and method of the present invention from the outside of a fixed cabinet.

A still better understanding of the system and method of the present invention for dispensing foil or film may be had from the description of the embodiments which follows. In some of the drawing figures, certain portions of either the brackets or the roll of foil or film are showed in dotted lines so that all portions of the illustrated embodiments may be clearly understood.

In the first embodiment 10 and as shown in FIGS. 1, 2, 3, and 4, the system and method of the present invention is shown mounted in a fixed cabinet 200 such as typically found in the kitchen of many residential dwellings. Such fixed cabinets 200 often include a row of substantially horizontally oriented false panels 202, similar to a drawer front. The false panels 202 are generally located under a work space 204 in either the middle portion of a fixed cabinet 200 or just beneath a counter top. Behind the false panels 202 is an empty unused space 205 in which the system and method of the present invention is placed.

Figure 2:
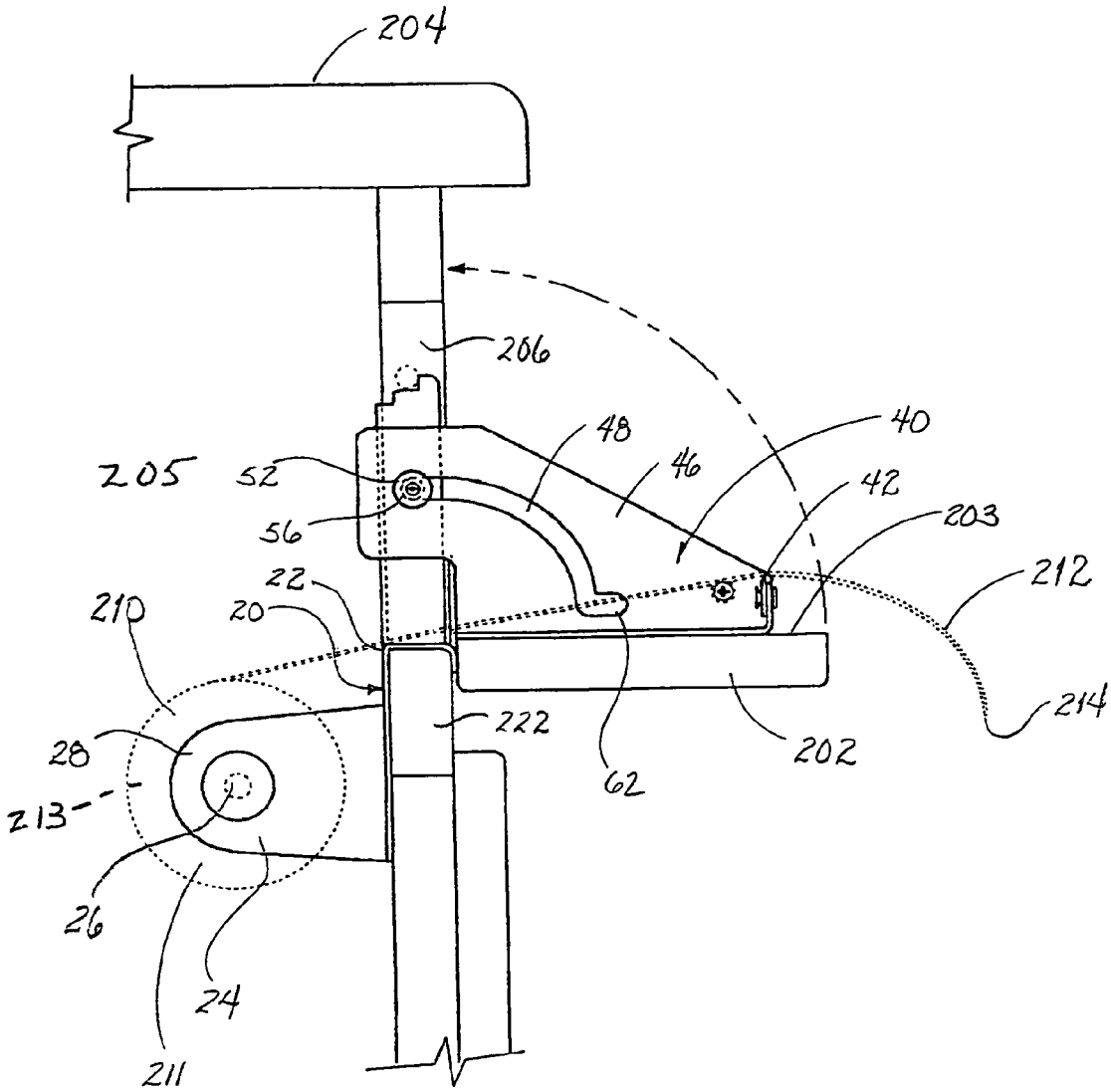
FIG. 2 is a side elevational view, in partial section, taken at line 2-2 of FIG. 1 with a hinged horizontally oriented panel shown in its open position.
Figure 4:
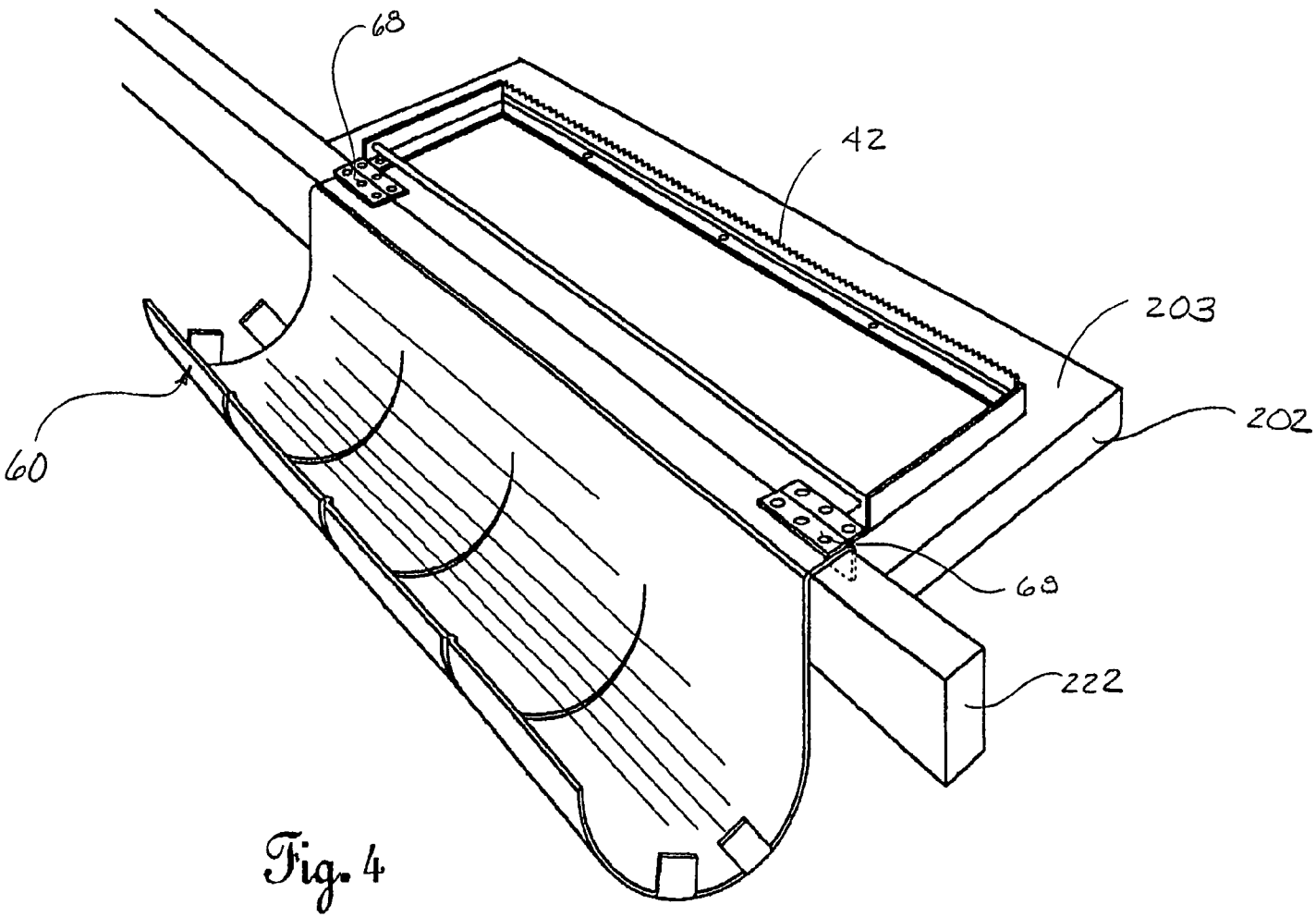
FIG. 4 is a perspective view of the first embodiment of the invention shown in FIG. 1 from the inside of the fixed cabinet showing an alternate design using a tray to store a roll of foil or film.

As may be seen in FIGS. 1, 2, and 4, the false panel portion 202 of the fixed cabinet 200 is shown as being hingedly mounted as a door so that it may be pulled down to expose an opening 206 in the front 208 of the fixed cabinet 200. Just beneath the opening 206 and behind the hingedly mounted panel 202 is placed a first bracket assembly 20. The first bracket assembly 20 has a mounting portion 22 and a portion 24 for holding either a roll of foil or a roll of film 210 so that the roll of foil or the roll of film 210 may rotate allowing a length of foil or film to be dispensed therefrom. The portion 24 which holds the roll of foil or the roll of film may include an axle 26 held in place by a pair of ears 28 positioned on either side of the first bracket assembly 20. In the preferred embodiment, the axle 26 runs through the roll of foil or the roll of film 210. In the alternative, short spindles affixed to each ear 28 may be used to hold the roll of foil or the roll of film 210 in position but will still allow the roll of foil or film 210 to turn. It is the purpose of the first bracket assembly 20 to position and store a large roll of foil or a large roll of film 210 in a heretofore unused space.

Positioned on the back 203 of hingedly mounted panel 202 is a second bracket assembly 40. The second bracket assembly 40 holds a foil or film cutting edge 42. The foil or film cutting edge 42 is oriented substantially parallel to the long axis of the roll of foil or film 210. At either end 44, 46 of the second bracket assembly 40 are cam slots 48, 50. The cam slots 48, 50 engage cams 52, 54 affixed to the first bracket assembly 20. Accordingly, when a user opens the hingedly mounted panel 202, the cam slots 48, 50 on the second bracket assembly 40 ride on the cams 52, 54 affixed to the first bracket assembly 20. Contact of the cams 52, 54 with the ends 56, 58 of the cam slots 48, 50 positions the open hingedly mounted panel 202 in a substantially horizontal position. Contact with the other ends 62, 64 of the cam slots 48, 50 holds the panel 202 in a closed substantially vertical position against the face of the cabinet 200. With the hingedly mounted panel 202 in a substantially horizontal open position, the user is able to pull on the edge 214 of the foil or film and cause a length of foil or film 212 to be dispensed from the unrolled foil or film 211 storage roll 210. The dispensed length of foil or film 212 is then drawn over the foil or film cutting edge 42. When the desired amount of foil or film has been withdrawn, the user exerts a force on the dispensed length of foil or film which brings the surface of the dispensed length of foil or film into contact with the foil or film cutting edge 42. The cutting edge 42 includes teeth 43 as shown in the preferred embodiment; however, those of ordinary skill in the art will understand that a variety of different types of cutting edges may be used. In some situations it may be necessary to place a guard over the cutting edge 42. Continual force on the dispensed length of foil or film will cause a cut to propagate across the width of the dispensed length of foil or film unrolled from the roll 210 thus giving the user a sheet of foil or film having a desired length. The open hingedly mounted panel 202 may then be moved back into its closed position. While the edge 214 of the foil or film will remain near the foil or film cutting edge 42, the cutting edge 42 may include a double row of teeth spaced close together so that front row of teeth will cut the foil or film and the rear row of teeth will hold the edge 214 of the foil or film near the cutting edge 42.

Figure 3:
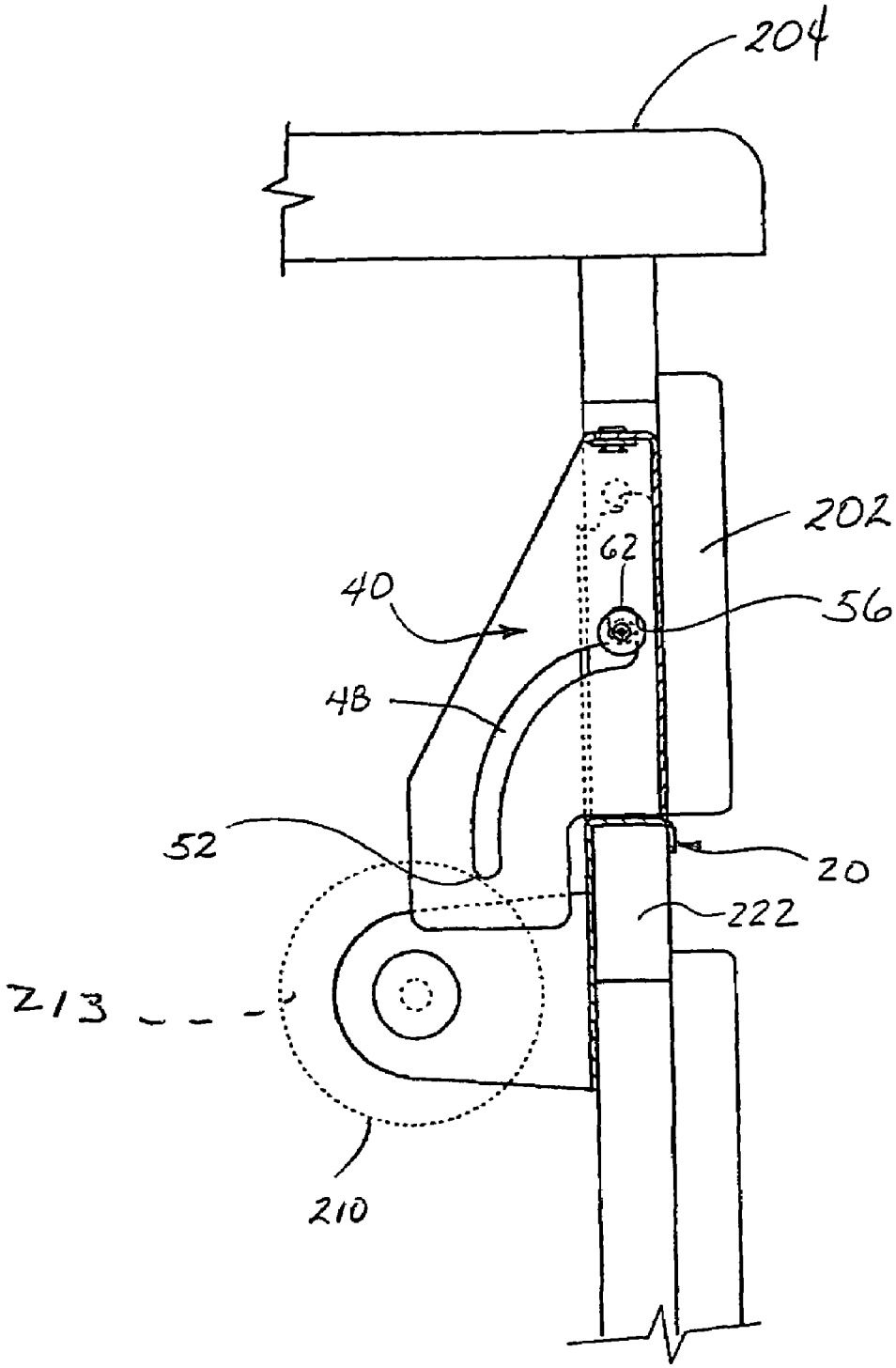
FIG. 3 is a side elevational view of the embodiment shown in FIG. 1 with the hinged horizontally oriented panel shown in its closed position.

Those of ordinary skill in the art will understand that the pair of ears 28 may be formed so as to provide a frictional force on the end 213 of the roll of foil or film 210. Such frictional force will have a braking effect and prevent uncontrolled unrolling of foil or film from the roll 210. Other braking systems to prevent uncontrolled unrolling of foil or film, such as bushings positioned on either end of the axle 26 near the pair of ears 28, will be well known to those of ordinary skill in the art. In still other situations, no braking action is required on the roll 210 and a simple substantially U-shaped tray assembly 60, as shown in FIG. 4, may be used to hold the roll of foil or film 210 or a stack of folded foil or folded film product (not shown) stacked like paper towels with back and forth folds. As shown in FIGS. 1, 2, and 3, panel 202 is hingedly attached 68 to cabinet brace 222 as shown in FIG. 4. Those of ordinary skill in the art will understand that the first embodiment 10 may be used even when a drawer 220 is located in the fixed cabinet as shown in FIG. 1.

Figure 5:
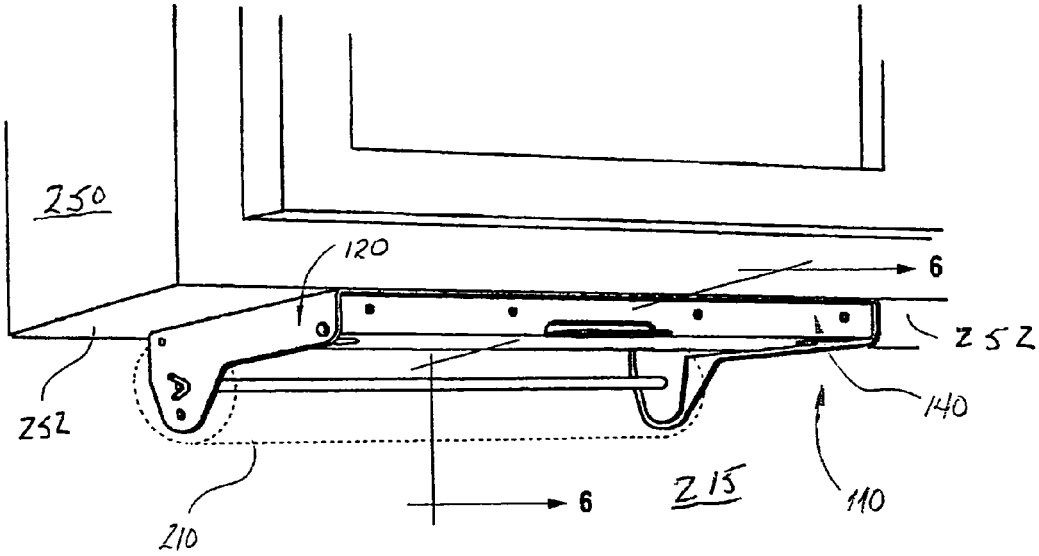
FIG. 5 is a perspective view of a second embodiment of the system and method of the present invention showing the mounting of the first bracket to the bottom of a wall mounted cupboard.
Figure 6:
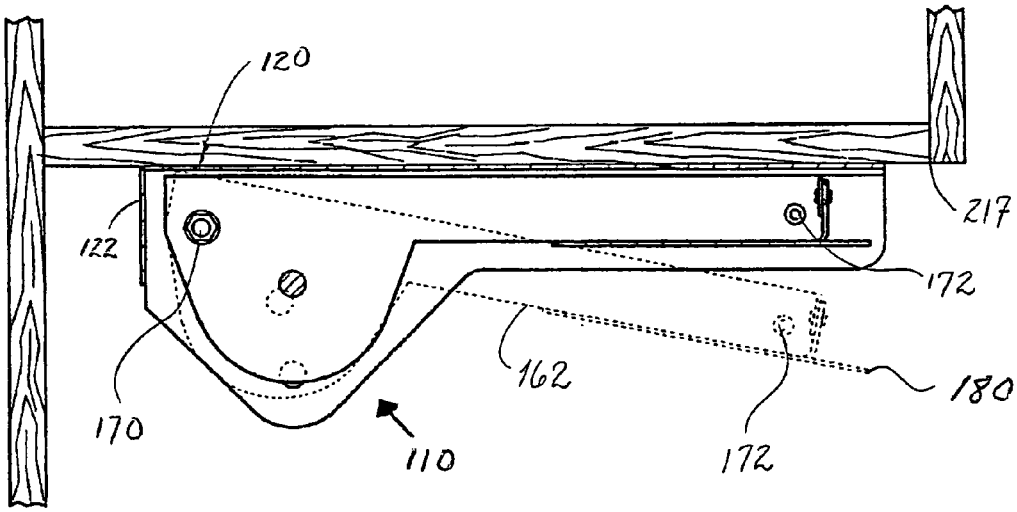
FIG. 6 is a side elevational view, in partial section, taken at line 6-6 of FIG. 5.
Figure 7:
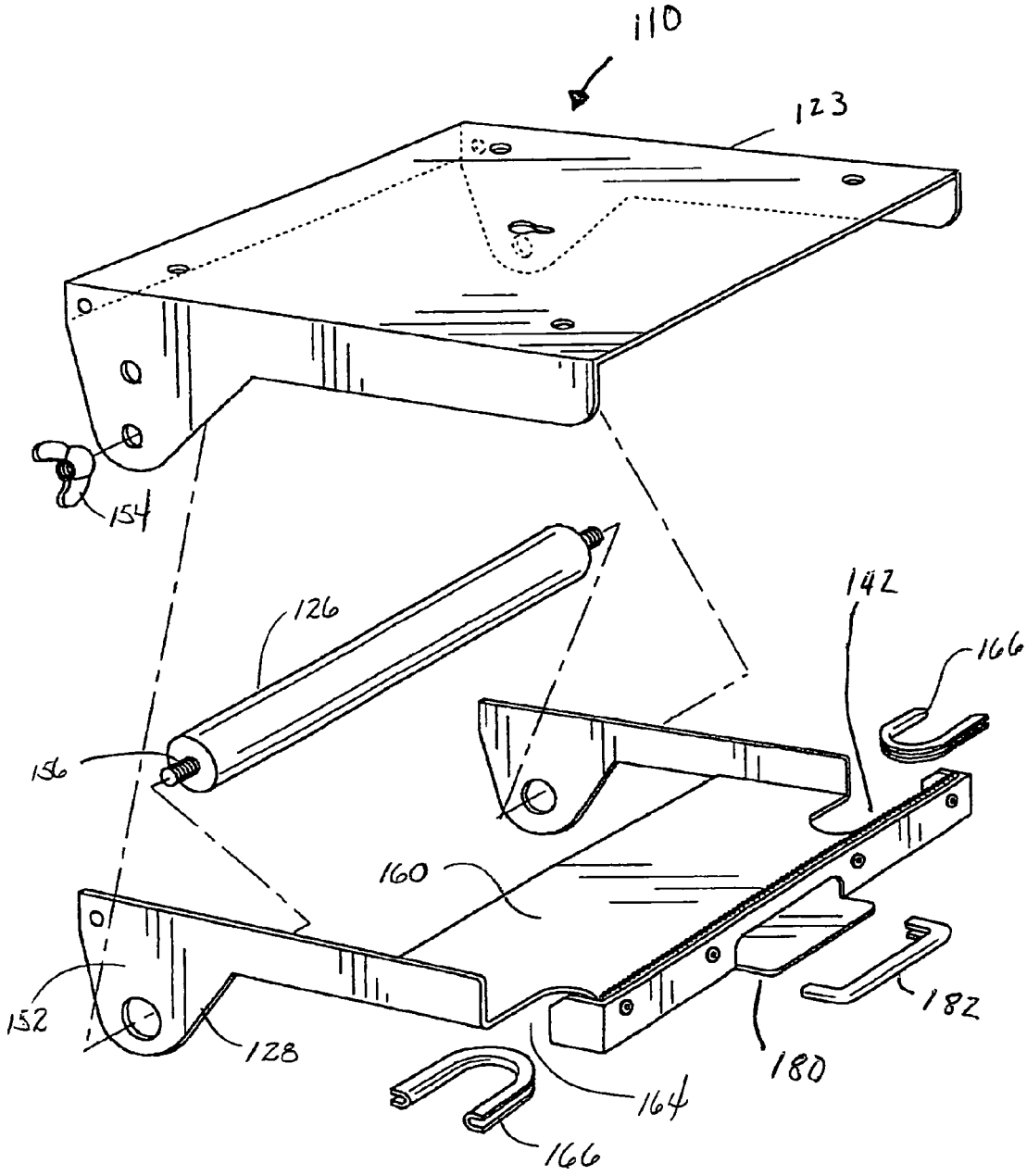
FIG. 7 is an exploded perspective view of the second embodiment of the invention shown in FIG. 5.

In a second embodiment 110 of the invention, the system and method of the present invention shown in FIGS. 5-7 is mounted under a wall mounted cupboard 250. Instead of being behind one of the false panels 202 on the front 208 of a fixed cabinet 200 as shown in FIGS. 1, 2, 3 and 4, the second embodiment 110 is mounted in another space which typically goes unused in a wall mounted cupboard 250. This unused space 215 is the space under a shelf or under a wall mounted cupboard 250. The shelf may be the bottom 252 of a wall mounted cupboard 250 or it may be one of the shelves in the cupboard 250.

As in the first embodiment 10, the system and method of the present invention, as shown in FIG. 5 and illustrated by the second disclosed embodiment 110, includes two bracket assemblies 120, 140. The first bracket assembly 120 has a mounting portion 122. In the second embodiment 110, the mounting portion 122 of the first bracket assembly 120 is a flat plate 123 which may be attached to the bottom side 252 of the wall mounted cupboard 250. Once mounted, the first bracket assembly 120 allows for placement of the second bracket assembly 140.

Unlike the first embodiment 10, the second bracket assembly 140 of the second embodiment 110 is hingedly attached 170 to the first bracket assembly 120 and includes a rear portion 152 for holding the roll of foil or film 210. When not in use the second bracket assembly 140 is held in a substantially horizontal position up against the first bracket assembly

120 with one or more detents 172 which use the flexibility of the first bracket assembly 120 to hold the second bracket assembly 140 in position. In the central portion 162 of the second bracket assembly 140 is a substantially flat tray portion 160 over which a length of the unrolled or dispensed film or foil 212 is drawn.

To use the second embodiment 110 of the system and method of the present invention, the second bracket assembly 140 is pulled down from the first bracket assembly 120 by placing fingers in the substantially U-shaped openings 164 to expose the foil or film cutting edge 142 at the front of the second bracket assembly 140. U-shaped openings 164 may be protected with sections of cut plastic tubing 166. Alternatively, a lip 180 covered with a section of cut plastic tubing 182 may be used. The length of foil or film 212 is dispensed from the roll 210 positioned in the rear portion 152 of the second bracket assembly 140 between mounting a pair of ears 128. As in the first embodiment 10, an axle 126 or spindles may be used. In the second embodiment 110, wing nuts 154 are threadably affixed to the threaded ends 156 of the axle 126 to hold the axle 126 in position between the pair of ears 128 on the second bracket assembly 140. As explained with regard to the first embodiment 10, bushings or some other system may be used to prevent uncontrolled unrolling of stored foil or film. Pulling on the edge 214 of the length of unrolled or dispensed portion of the foil or film 212 will draw the foil or film over the foil or film cutting edge 142. When the desired length of foil or film has been obtained, the foil or film is pulled down against the foil or film cutting edge 142 so that the desired length of a foil or film sheet may be removed from the roll of stored foil or film 210. The cutting edge 142 may include teeth, prongs, or a straight edge depending on the type and/or thickness of foil or film to be cut into sheets. The second bracket assembly 140 is then moved upwardly to be put back in contact with the first bracket assembly 120 and held in that position by detents 172.

The edge 214 of the foil or film remains at the foil or film cutting edge 142 ready for use as needed. As explained with respect to the first embodiment 10, multiple rows of teeth may be used, one row of teeth to cut the foil or film, and the other row of teeth to hold the foil or film once cut.

Those of ordinary skill in the art will understand that a variety of foil or film products may be used with the system and method of the present invention to include aluminum foil, plastic film, wax paper or any other type of film or paper product available in rolls or stacked with back and forth folds. If sufficient space is available in a cabinet, a user may make plural use of the system and method of the present invention for multiple rolls of different types of foil or film.

It has been found that commercial sized aluminum foil rolls having up to 500 linear feet of available foil may be used with the system and method of the present invention. If a plastic film is used, commercial size roll lengths of up to 750 linear feet can be accommodated. Thus, instead of frequently replacing rolls of foil or film, a user of the system and method of the present invention will be able to save money by buying a large quantity of foil or film wherein the cost per unit length is much less than the more commonly available smaller rolls. It is expected that some users will be able to go a year or more without having to replace a roll of foil or film. The width of the roll of foil or film that can be used depends on the width of the available space in the fixed cabinet or wall mounted cupboard.

While the system and method of the present invention has been described according to the foregoing embodiments, those of ordinary skill in the art will understand that still other embodiments have been enabled by the foregoing disclosure. Such other embodiments shall be included within the scope and meaning of the appended claims.

What is claimed is:

1. A method for dispensing foil or film product from a fixed cabinet enclosing an empty space, said cabinet having a hinged horizontally oriented door with a front side and a back side, and internal braces, said method comprising the step of:

mounting a first bracket assembly to an internal brace within the fixed cabinet whereby said first bracket assembly will be positioned in the empty space within the fixed cabinet substantially beneath and behind the hinged horizontally oriented door for storing the foil or film product;

mounting a second bracket assembly having a foil or film cutting edge to the back side of the hinged horizontally oriented door;

connecting said first bracket assembly and said second bracket assembly together with a cam and slot system for controlling the opening of the hinged horizontally oriented door;

mounting a roll of foil or film in said first bracket;

whereby a sheet of foil or film may be dispensed by opening the hinged horizontally oriented door, pulling out a section of foil or film, cutting the foil or film into a sheet with said foil or film cutting edge.

2. The method as defined in claim 1 wherein said first bracket prevents the uncontrolled unrolling of the roll of foil or film product.

* * * * *